United States Patent [19]

Uetani

[11] Patent Number: 4,553,639

[45] Date of Patent: Nov. 19, 1985

[54] ELEVATOR SUPERVISION SYSTEM

[75] Inventor: Kenichi Uetani, Aichi, Japan

[73] Assignee: Mitsubishi Denki Kabushiki Kaisha, Tokyo, Japan

[21] Appl. No.: 577,781

[22] Filed: Feb. 7, 1984

[30] Foreign Application Priority Data

Feb. 21, 1983 [JP] Japan ..... 58-27274

[51] Int. Cl.[4] ..... B66B 1/18

[52] U.S. Cl. ..... 187/29 R

[58] Field of Search ..... 187/29

[56] References Cited

U.S. PATENT DOCUMENTS 4,411,338 10/1983 Kuzunuki et al. ..... 187/29

4,458,787 7/1984 Uetani ..... 187/29

FOREIGN PATENT DOCUMENTS 54-70544 6/1979 Japan .

56-88078 7/1981 Japan .

2115578A 9/1983 United Kingdom .

*Primary Examiner*—William M. Shoop, Jr.

*Assistant Examiner*—W. E. Duncanson, Jr.

*Attorney, Agent, or Firm*—Wenderoth, Lind & Ponack

[57] ABSTRACT

An elevator supervision system has a microcomputer type car control connected to a load sensor for sensing a load on an associated elevator car, a microcomputer type group supervision device connected to floor pushbuttons and a clock, and a microcomputer type statistical device connected in two ways to the group supervision device which is connected in two way to the car controls, the statistical device setting a starting and an ending time of a crowded traffic pattern of the elevator cars on every day and recording them for past M days and calculating their mean values and dispersions, the group supervision device receiving data from the statistical device to cause the car controls to control the operation of the cars through associated driving controls and hoist motors.

5 Claims, 6 Drawing Figures

ELEVATOR SUPERVISION SYSTEM

BACKGROUND OF THE INVENTION

This invention relates to improvements in a system for supervising the operation of elevator car or cars in accordance with an operational learning procedure.

Lately there have been proposed measures to control the operation of an elevator car or cars by storing the past status of traffic of the elevator car or cars or making the statistic thereof and predicting the status of traffic thereof in the future. For example, such measures are described in Japanese laid-open patent application Nos. 115,566/1980, 62,179/1982, etc. These Japanese laid-open patent applications disclose the co-called operational learning procedure in which the statistics of the past traffic of the elevator car or cars are determined and the present or future traffic and service is accurately predicted at an early stage from the results of the statistics so as to thereby improve the service by the elevator car or cars.

On the other hand, it is known that specified traffic congestion occurs within buildings used for offices, hotels, etc. In buildings used for offices, for example, traffic streams from the entrance floor flowing to the individual floors are high in the office-going hour while traffic streams from the individual floor directed to a restaurant floor increases in the first half of the lunch hour and those from the restraurant floor directed to the individual floors are great in the second half of the lunch hour. Also, traffic streams from the individual floors directed to the entry floor increase in the office closing hour. A group supervision device is responsive to traffic patterns formed of different traffic streams as described above to operate two elevator cars or perform the preference operation so as to thereby improve the service by the elevator cars.

However, time periods for which those traffic patterns are selected are not particularly fixed and it is difficult to predict the time periods. Especially before the establishment of a building, the abovementioned prediction is extremely difficult. Thus, it is difficult to be said that sufficient regard is paid to the prediction.

Accordingly, it is an object of the present invention to provide a new and improved elevator supervision system for predicting traffic patterns with a high accuracy while being capable of flexibly accommodating traffic within a building whose traffic can not be predicted before the establishment thereof.

SUMMARY OF THE INVENTION

The present invention provides elevator supervision system for supervising the operation of elevator cars by determining statistic of past traffic statuses of the elevator cars with respect to a time thereof on every day, and predicting a present or a future traffic status of the elevator cars from the results of the statistics; the which system comprises a traffic pattern sensing means for sensing and storing a time of selection of a traffic pattern of the elevator cars on every day, and a traffic pattern selecting means for predicting a time of selection of a present or a future traffic pattern of the elevator cars from the sensed times of selection of the past traffic patterns.

In a preferred embodiment of the present invention, the traffic pattern sensing means is responsive to a load on the elevator car of not less than a predetermined magnitude so as to determine a starting time of selection of the traffic pattern of the elevator cars and is also responsive to the absence of the elevator car with a load of not less than the predetermined magnitude for a predetermined time interval so as to determine an ending time of selection of the traffic pattern of the elevator cars.

The traffic pattern selecting means calculates the mean value of the sensed times of selection of the past traffic patterns and predicts a time of selection of a present or a future traffic pattern from the calculated mean value.

The present invention may also comprise a traffic pattern setting means for calculating a dispersion of the sensed times of selection of the past traffic patterns of the elevator cars and for setting a predetermined time of selection of the traffic pattern in response to the dispersion of not less than a predetermined magnitude.

BRIEF DESCRIPTION OF THE DRAWINGS

The present invention will become more readily apparent from the following detailed description taken in conjunction with the accompanying drawings in which.

DESCRIPTION OF THE PREFERRED EMBODIMENTS

Figure 1:
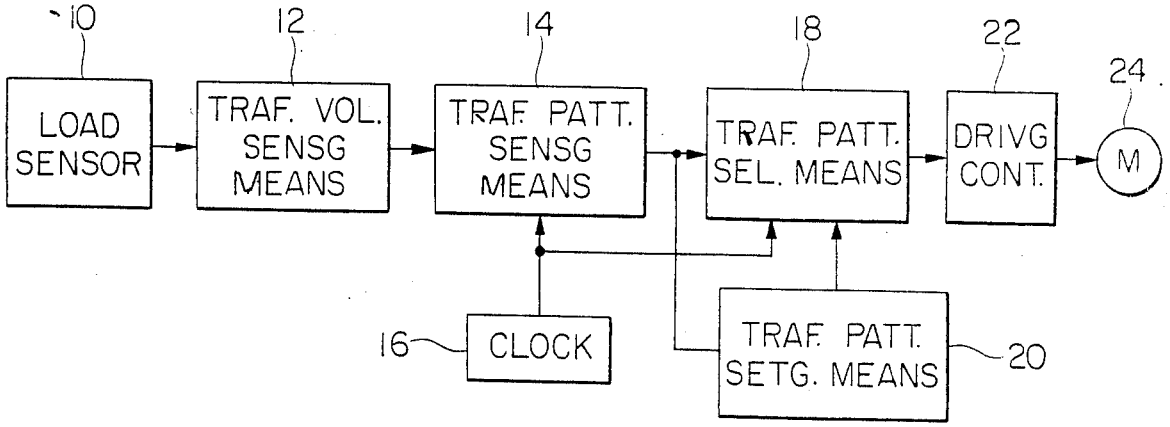
FIG. 1 is a block diagram of one embodiment according to the elevator supervision system illustrated in functional means except for some components.

Referring now to FIG. 1 of the drawings, there is illustrated one embodiment according to the elevator supervision system of the present invention. The illustrated arrangement comprises a load sensor 10 for sensing a load on an associated elevator car, a traffic volume sensing means 12 connected to the load sensor 10 to sense a traffic volume of the elevator car from an output from the load sensor 10, a traffic pattern sensing means 14 connected to both the traffic volume sensing means 12 and a clock 16 to sense a time of selection of a traffic pattern from outputs from the traffic volume sensing means 12 and an output from the clock 16, a traffic pattern selection means 18 connected to both the traffic pattern sensing means 14 and the clock 16 to predict a present or a future time of selection of the traffic pattern from both the past times of selection of the traffic pattern sensed by the traffic pattern selection means and the output from the clock 16, and a traffic pattern setting means 20 connected to the traffic pattern sensing means 14 so as to be responsive to a dispersion of the past times of selection of the traffic patterns sensed by the traffic pattern sensing means 14 which is in excess of a predetermined magnitude so as to set a predetermined time of selection of a traffic pattern.

The arrangement further comprises a driving control 22 connected to the traffic pattern selection means 10 so as to drive and control a hoist motor 24 in accordance with the traffic pattern from the traffic pattern selection means 18.

It is noted that the arrangement of FIG. 1 is provided for each of elevator cars included in one group.

Figure 2:
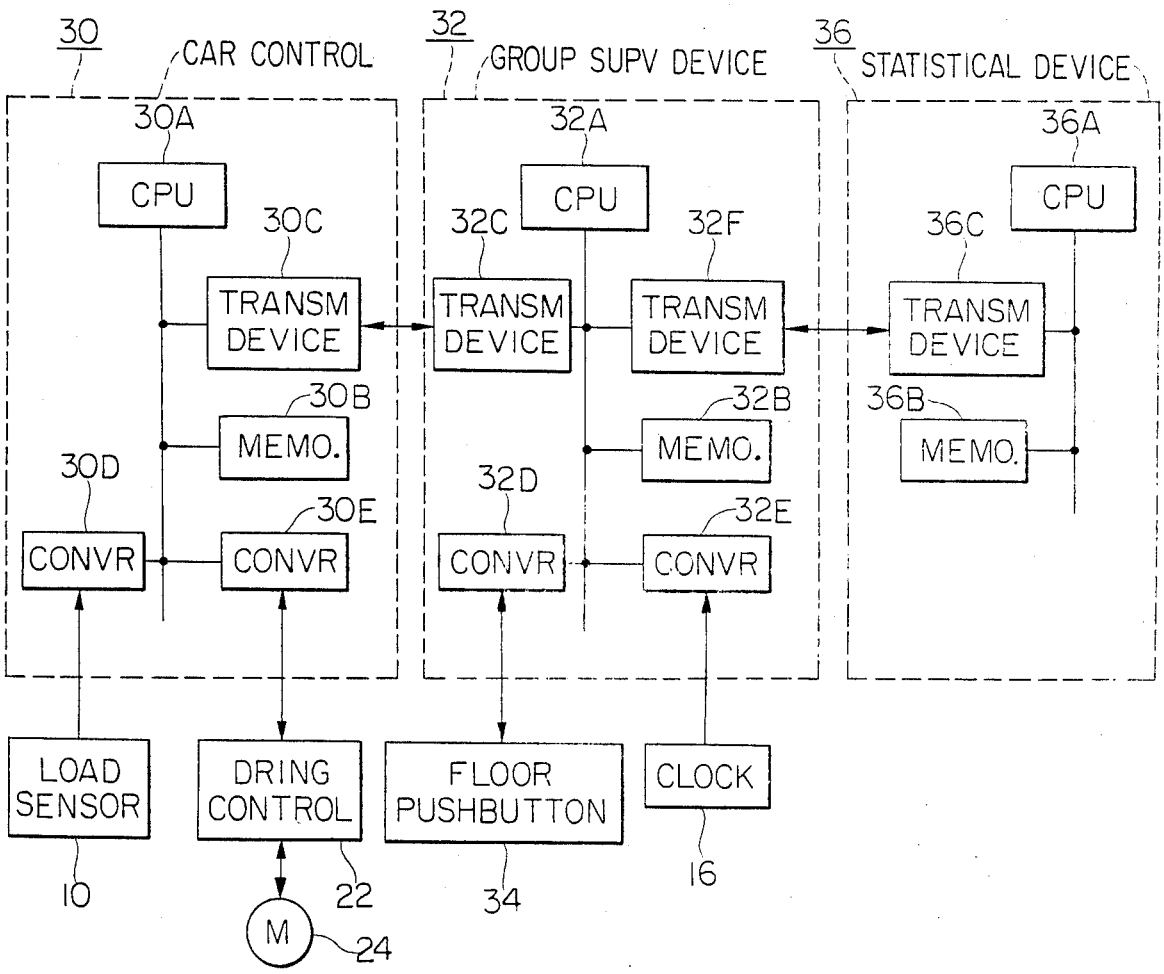
FIG. 2 is a block diagram of the details of the arrangement shown in FIG. 1.

As shown in FIG. 2, the load sensor 10 is connected to an elevator car control generally designated by the reference numeral 30. The car control 30 is shown only for a single elevator car and is composed of a microcomputer. More specifically, the car control 30 includes a central processing unit 30A (which is abbreviated hereafter as a ("CPU") connected to a memory 30B, a transmission device 30, and a pair of converters 30D and 30E. The memory 30B is formed of a read only memory (which is abbreviated hereafter as an "ROM" and is not shown) for storing a program and fixed value data therein, and a random access memory (which is abbreviated hereafter as an "RAM" and is not shown) for temporarily storing data concerning the results of calculations and others and capable of reading out and writing data therefrom and therein. The transmission device 30C is operative to send and receive data to and from the central processing unit 30A. Also, the converter 30D is connected to the load sensor 10 to change a signal level between its input and output and the converter 30F is connected in two ways to the driving control 22 and is similar in operation to the converter 30D.

In FIG. 2, a group supervision device generally designated by the reference numeral 32 and formed of a microcomputer is shown as including a CPU 32A, a memory 32B, a transmission device 32C and a pair of converters 32D and 32E interconnected in the same manner as the corresponding components of the car control 32 excepting that another transmission device 32F is connected to the CPU 32A and that the converter 32D is connected in two ways to a floor pushbutton 34 disposed at each of a plurality of floors in a building served by associated elevator cars and the converter 32E is connected to the clock 16. Also, the transmission device 32C is connected in two ways to the transmission device 30C included in the car control 30.

It is noted that the group supervision device 32 is provided for each group including a plurality of elevator cars.

Furthermore FIG. 2 shows a statistical device generally designated by the reference numeral 36. The statistical device 36 is also formed of a microcomputer and include a CPU 36A, and a memory 36B and a transmission device 36 connected to the CPU 36A. The transmission device 36C is also connected in two ways to the transmission device 32F included in the group supervision device 32.

The CPU, the memory, and the transmission device included in each of the group supervision devices 32 and the statistical devices 36 are identical to the corresponding components disposed in the car control 30.

The operation of the arrangement shown in FIG. 2 will now be described. When the floor pushbutton 34 is depressed, the resulting signal enters the CPU 32A through converter 32D until it is registered in the CPU 32A. Then, a floor call at that floor having the depressed floor pushbutton 32 is assigned to the optimum one of the elevator cars included in an associated group. The assigned signal is entered into the CPU 30A through the transmission devices 32C and 30C to be processed by the CPU 30A to provide the processed result. This result from the CPU 30A is delivered via the transmission device 30E to the driving control 22 which, in turn, drives the hoist motor 24 resulting in the operation of the assigned elevator car. That is, the assigned elevator car responds to the floor call assigned thereto.

The process as described above is well known in the art.

On the other hand, the statistical device 36 is operated to sense a traffic volume of the assigned elevator car from the output from the associated load sensor 10 and also sense a time of selection a congestion pattern due to getting-on in the office going hour at the main floor (which is normally the first or ground floor) from both the sensed traffic volume and the output from the clock 16. Then, the times of selection of the congestion pattern or data thus sensed are stored in the memory 36B for a number of past days. Subsequently, a starting and an ending time of an operation pattern in the office going hour are determined by those data and the output from the clock 16 and the associated elevator car are operated.

At that time, a dispersion of each of the past starting and ending times relative to the now determined associated time may exceed a predetermined magnitude. In this case, the starting and ending times are set to predetermined starting and ending times stored in the memory 36B followed by the operation of the elevator cars.

The foregoing is equally applicable to a congestion pattern due to getting-off at a restaurant floor in a first half of the lunch hour.

The description will now be made in conjunction of the operation of sensing a congestion pattern due to getting-on at the main floor in the office-going hour and with reference to FIG. 3 wherein there is illustrated a program stored in the memory 36B to sense such a congestion pattern. The program is repeatedly executed with a period of, for example, 0.1 second.

Starting with the step labelled "START", the step 100 determines if the present time is in the office-going hour, that is to say, if the present time is at or after a time $J_1$ when the office-going hour begins and before a time $J_2$ when the same is ended. It is noted that a time interval between the times $J_1$ and $J_2$ is preset to be somewhat larger than a predetermined time interval. When determined so in the step 100, the step 102 determines if a signal UPE indicating the setting of the ending time is of a binary ONE. When the signal UPE is of a binary ZERO as determined in the step 102, the step 104 initially sets the serial number n of a scanned elevator car to a ZERO. Then, the step 106 is entered where the serial number n of the scanned elevator car is updated the scanned car is updated to a decimal ONE indicating an elevator car No. 1. Generally, the serial number n of the scanned car is updated to the serial number $(n+1)$ of the next scanned car. Thereafter, the step 108 determines if the scanned elevator car No. 1 has departed from the main floor in an up direction. When it is so determined in the step 106, the step 108 determines if a load $LD_n$ on the elevator car No. 1 is not less than a predetermined magnitude $K_1$ which is, for example, 70% of a rated number of passengers in the elevator car. When the load $LD_n$ is less than the predetermined magnitude $K_1$, as determined in the step 108, the step 110 determines if all the elevator cars have been scanned. When all the elevator cars have not been scanned, as determined in the step 120, the program is returned back to the step 106 to repeat the steps 106, 108 and 110.

If the step 108 gives an answer "NO", then the program goes directly to the step 112.

After all of the elevator cars have been scanned, as determined in the step 112, the step 114 determines if the signal UPS is of a binary ONE. Since the signal UPS at that time is still of a binary ZERO, the step 114 does not go to the step 116. As a result, the step 116 and the succeeding steps 118 and 120 are not executed.

When the load $LD_n$ on the elevator car No. 1 is not less than the predetermined magnitude $K_1$, as determined in the step 110, the step 122 determines if the signal UPS is equal to a binary ONE. Since the signal UPS is still of a binary ZERO as described above, the step 122 goes to the step 124 where the signal UPS is set to a binary ONE and the present time is set to a starting time on this day. Then, the step 126 clears a count $T_1$ on a counter (not shown) after which the step labelled "END" is entered.

Following this, the next succeeding calculation period is started. In this calculation period, the step 122 determines that the signal UPS is of a binary ONE. Thus, the step 124 is not executed but the step 126 is entered.

Then, the steps 110, 122 and 126 are successively executed so long as the load $LD_n$ on the elevator car No. 1 is not less than the predetermined magnitude $K_1$. However, if the step 110 determined that the load $LD_n$ on the elevator car No. 1 is less than the predetermined magnitude $K_1$, then the step 110 goes to the step 116 through the steps 122 and 114. In the step 116, the counter (not shown) updates its count $T_1$ by adding the calculation time of 0.1 to a time interval SEC elapsed from the preceding calculation period in incremental manner. Then, the step 118 determines if the elapsed time interval SEC continues for a predetermined time interval $K_2$ (which may be, for example, 120 seconds). When it is so determined in the step 118, the step 120 sets a signal UPE indicating the setting of the ending time to a binary ONE and also sets an ending time $VEJ_o$ a on this day to the present time after which the step END is entered.

On the other hand, when step 128 gives an answer "YES", the step END is entered. Also, when the step 118 gives an answer "NO", the step END is entered.

For the next succeeding calculation period, the step 102 determines that the signal UPE indicating the seting of an ending time is of a binary ONE and the steps 104 through 120 are not executed. When the step 100 determines that the present time is not in the office-going hour, the program goes to the step 128 where a determination is made as to whether or not the signal UPE is of a binary ONE. When the signal UPE is not of a binary ONE, as determined in the step 128, the step 130 sets the signal UPE to a binary ONE and also an ending time UEF on this day to the present time after which the step END is entered. When the signal UPE is of the binary ONE, as determined in the step 128, the program goes directly to the step END.

From the foregoing it is seen that, upon sensing the elevator car with its load being not less than the predetermined magnitude $K_1$ departing from the main floor in the up direction, the starting time $USJ_o$ is set. Thereafter, when such elevator cars are continuously sensed within the predetermined time interval $K_2$, the operation of the elevator cars in the office-going hour is regarded to be continuous. On the other hand, when the elevator cars as described above are not sensed within the predetermined time interval $K_2$, the ending time UEF is set to a time point when such elevator cars are not sensed.

Figure 4:
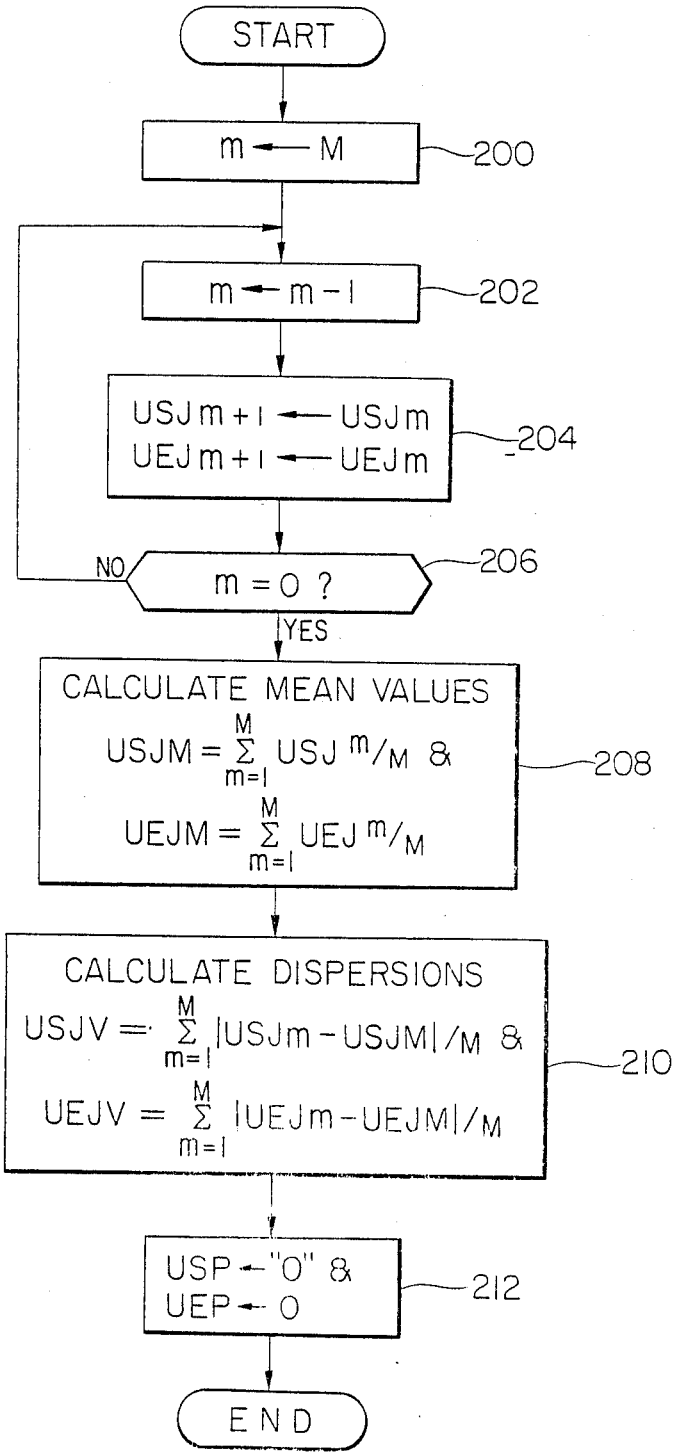
FIG. 4 is a flow chart for programming the transfer of statistical values, and calculations of the mean values and dispersions of past starting and ending times of an operation pattern developed in the office going hour.

Subsequently, the operations of transferring statistical values and calculating mean values of the starting and ending times set as described above on a number of past days and dispersions of the latter will now be described in conjunction with FIG. 4 wherein there is illustrated a flow chart of a program for those operations stored in an ROM (not shown) included in the memory 36C of the statistical device 36. The program is executed once a day, for example, just at twelve o'clock midnight.

Starting with the step labelled START, the step 200 initially sets the number of scanned day m to the number of past days M during which the statistic has been permitted to be done. Then, the step 202 updates the number of scanned days m to the number of past M−1 days by subtracting one from the number of scanned days m. Then, the step 204 is entered where data on the m days ago are set to data on the (m+1) days ago. That is, the starting and ending times $USJ_m$ and $UEJ_m$ respectively on the m days ago are set to those on the (m+1) days ago designated by reference characters $USJ_{m+1}$ and $UEJ_{m+1}$ respectively. Subsequently, the step 206 determines if the number of scanned days m is equal to zero that is to say, if the scan has continued up to this day. When the scan is not yet completed, as determined in the step 206, the program is returned back to the step 202 to repeat the steps 202, 204 and 206 one after another.

Thus, data on this day is transferred to data on one day ago, which is, in turn, transferred to data on the two days ago and so on. Thus, data on M days are successively transferred and stored in the memory.

When the scan up to this day has been completed, as determined by the step 206, the step 208 calculates the mean value USJM of the starting times $USJ_m$ and the mean value of the ending times $UEJ_m$ on the past M days according to $$\sum_{m=1}^{M} USJ_m/M \text{ and } \sum_{m=1}^{M} UEJ_m/M$$

respectively. Then, the step 210 calculates a dispersion USTV of starting times and that UEJV of the ending times on the past M days with respect to the respective mean values according to $$\sum_{m=1}^{M} |USJ_m - USJM|/M$$

and $$\sum_{m=1}^{M} |UEJ_m - UEJM|/M$$

respectively. Thereafter, the step 212 resets the signal UPS indicating the setting of the starting time and the signal UPE indicating the setting of the ending time to binary Zero's.

Then, the program is entered into the step labelled END whereupon the the program is ready for the next succeeding operation.

Figure 5:
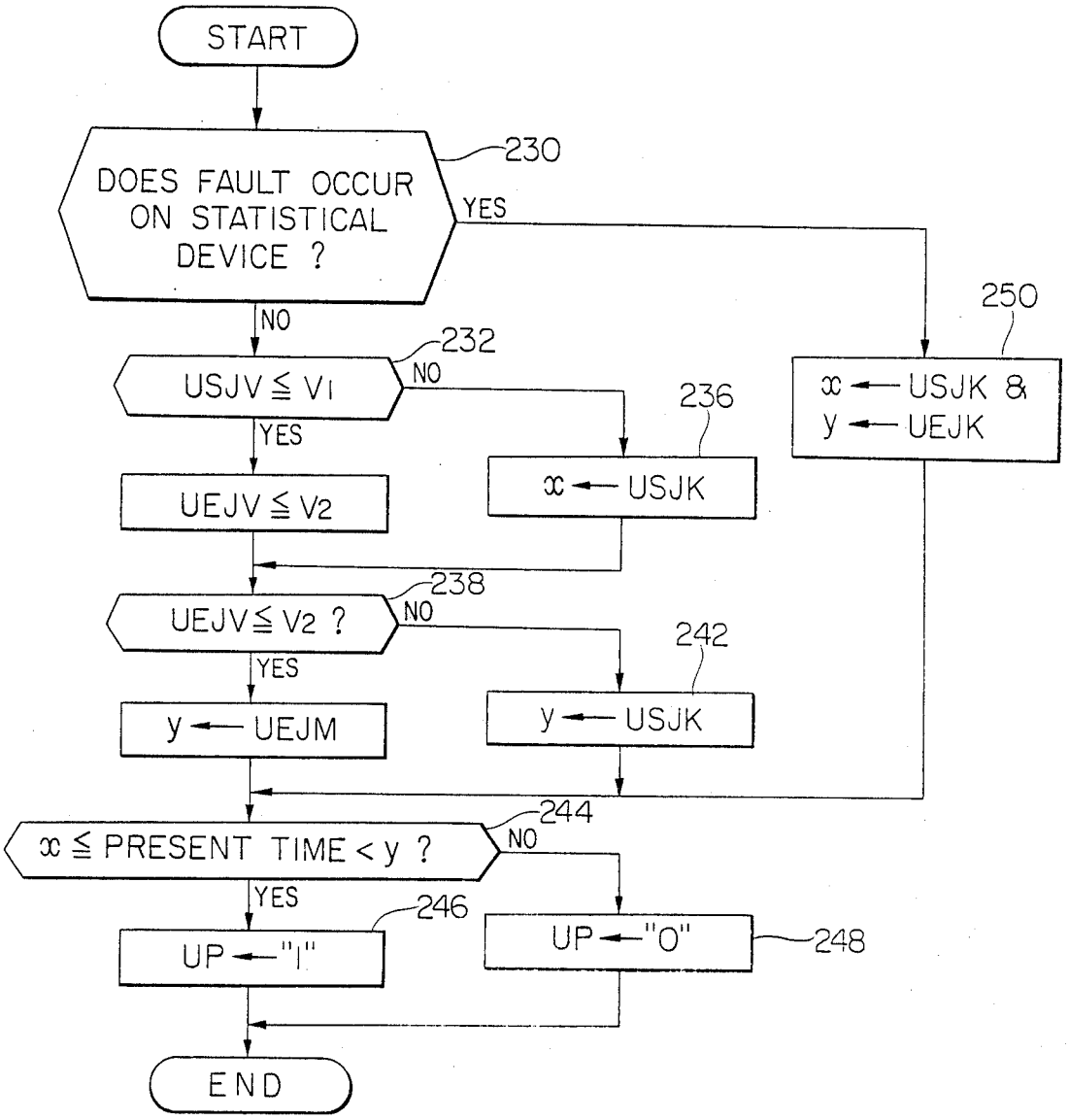
FIG. 5 is a flow chart for programming the selection of the operation pattern in the office going hour.

The operation of selecting the operation pattern developed in the office-going hour will now be described in conjunction with FIG. 5 wherein there is illustrated a flow chart of a program for performing such an operation stored in the memory 32B included in the group supervision device 32.

Starting with the step labelled START, the step 230 determines if a fault occurs on the statistical device 36. When no fault occurs on the statistical device 36, as determined by the step 230, the step 232 determines if the dispersion USJV, as described above, is not larger than a predetermined magnitude $V_1$ which may be, for example, of ten minutes. When it is so determined in the step 232, the step 234 sets a starting time x to the mean value USJM of the starting times calculated by the statistical device 36, as described above. On the other hand, when the dispersion USJV exceeds the predetermined value $V_1$, as determined in the step 232, the step 236 sets the starting time x to a starting time USJR preliminarily stored in an ROM (not shown) included in the memory 32B.

In either case, the step 238 is entered. The step 238 determines if the dispersion UEJV of the ending times is not larger than a predetermined magnitude $V_2$ which may be, for example of twenty minutes. When it is so determined in the step 338, the step 240 sets an ending time y to the mean value UEJM of the ending times calculated by the statistical device 36, as described above. When the step 238 gives an answer "NO", the step 242 sets the ending time y to an ending time UEJK preliminarily stored in the abovementioned ROM.

In either case, the step 244 is entered. The step 244 determines if the present time is at or after the starting time x and before the ending time y. That is, if the present time is in a selected pattern hour. When it is so determined in the step 244, the step 245 sets a command operation signal UP in the office-going hour to a binary ONE with the result that the elevator cars are operated in the manner as predetermined in the office-going hour. However, such an operation is not described because the same does not form a part of the present invention.

When the present time is not in the selected pattern hour, as determined in the step 244, the step 248 sets the command operation signal UP as described above to a binary ZERO. This results in the release of the operation in the office-going hour.

Either of the steps 246 and 248 goes to the step labelled "END".

When the occurrence of a fault on the statistical device 36 is determined in the step 230, the step 250 sets the starting and ending times x and y to the starting and ending times USJK and UEJK preliminarily stored in the ROM as described above. Then, the steps 244 and 246 or 248 are repeated.

Figure 6:
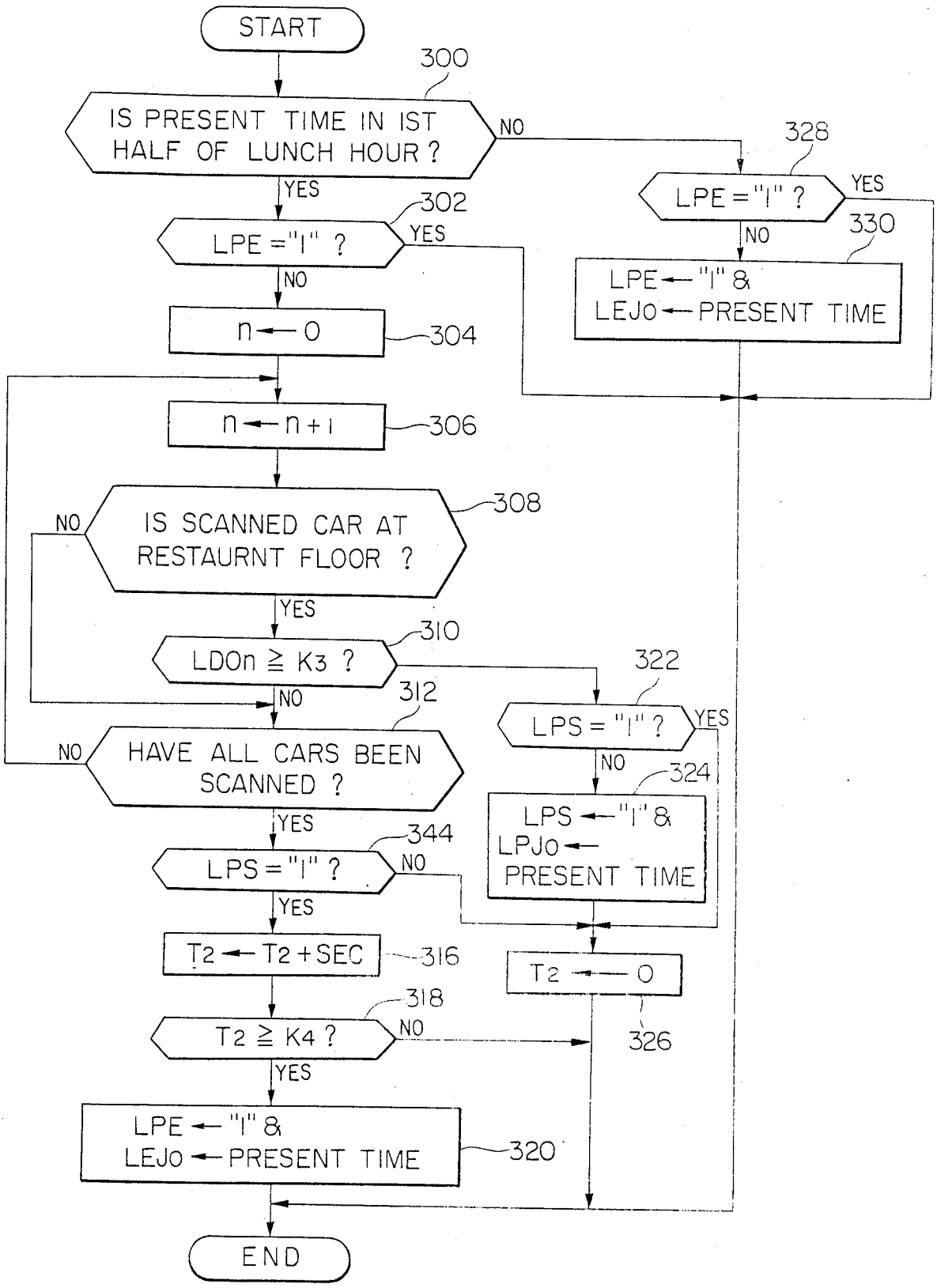
FIG. 6 is a flow chart modified from that shown in FIG. 3 so as to sense a congestion pattern developed in a first half of a lunch hour.

FIG. 6 is a flow chart illustrating a modification of the present invention for sensing a traffic pattern which is crowded due to getting-off at the restaurant floor in the first half of the lunch hour. The steps are identical to those shown in FIG. 3 respectively and designated by the reference numerals identifying the corresponding steps shown in FIG. 3 and prefixed with 300 but not 100. For example, the step 230 determines if the present time is in the first half of the lunch hour. In other words, the term "office-going hour" reads "the first half of the lunch hour" in FIG. 6. Similarly the term "stating time $J_1$ of the office-going hour" reads a "starting time $J_3$ of the first half of the lunch hour" and the term "the ending time $J_2$ of the former" reads an "ending time $J_4$ of the latter". The term "signal UPS indicating the setting of the starting time of the office-going hour" reads a "signal LPS indicating the setting of the starting time of the first half of the lunch hour" and the term "signal UPE indicating the setting of the ending time of the office-going hour" reads a "signal LEP indicating the setting of the first half of the lunch hour". Also, the term "starting time $USJ_o$ of the office-going hour on this day" read a "starting time $LSJ_o$ of the first half of the lunch hour on this day" and the term "ending time $UEJ_o$ of the office-going hour on this day" reads an "ending time $LEJ_o$ of the first half of the lunch hour of this day". Furthermore, the term "predetermined magnitude $K_1$" appearing in the step 110 reads an predetermined magnitude $K_3$ (which may, for example, be 40% of the rated number of passengers appearing in the step 310 and the term "predetermined time interval $K_2$" appearing in the step 118 reads "predetermined time interval $K_4$" (which may, for example, be 120 seconds) appearing in the step 318. Finally, the term "count $T_1$" set forth in the step 116 reads a "count $T_2$" denoted in the step 316 and the term "load $LD_n$ on the elevator car" reads a "decrease in load $LDO_n$ on the elevator car".

Figure 3:
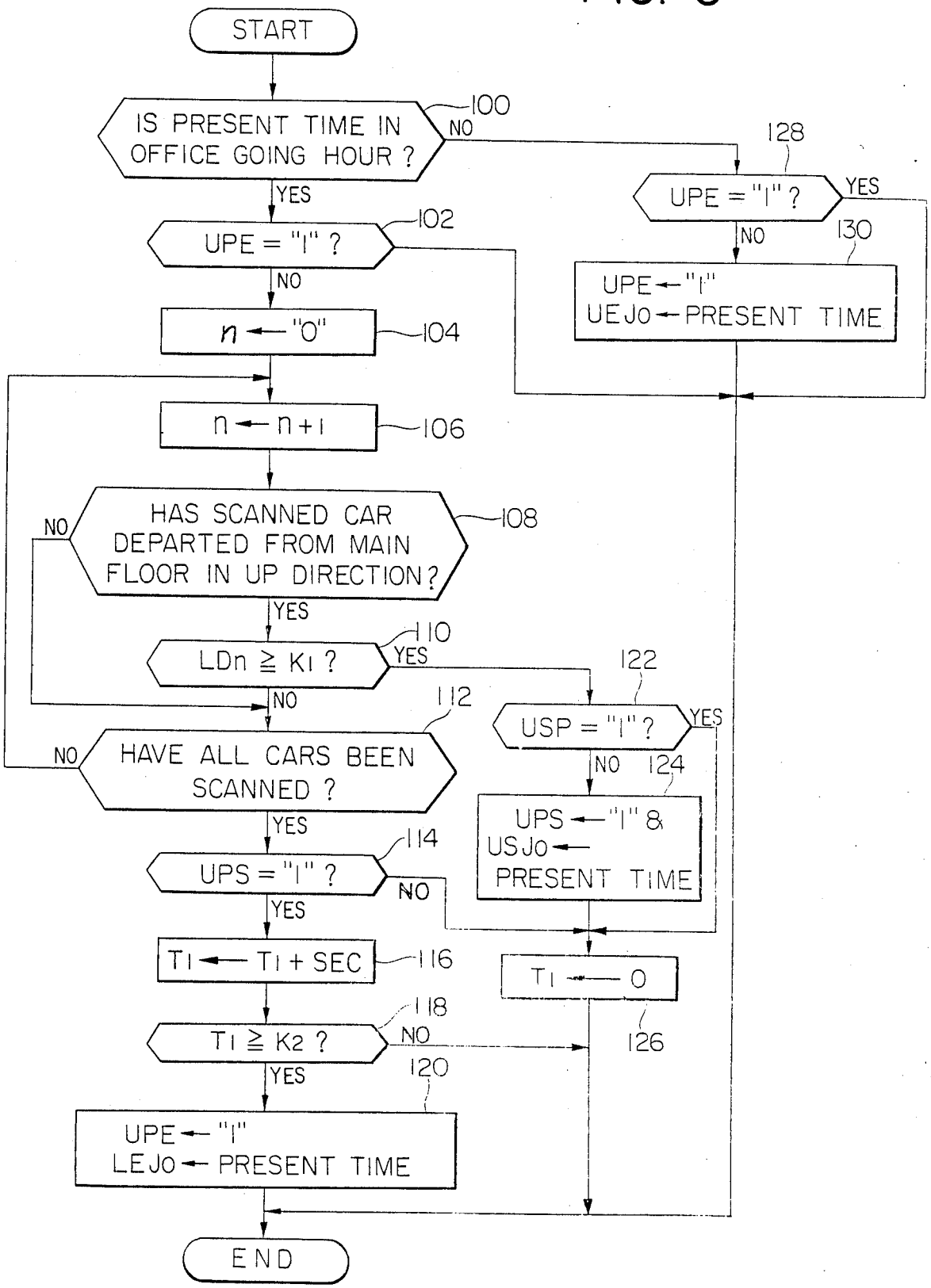
FIG. 3 is a flow chart for programming the sensing of a congestion pattern due to getting-on in the office going hour by using the statistic device shown in FIG. 2.

By reading the terms as described above, and using the arrangements shown in FIGS. 1 and 2, the steps illustrated in FIG. 6 are successively executed in the same manner as those illustrated in FIG. 3.

When the step 310 determines that a decrease in load $LDO_n$ due to getting-off at the restaurant floor in the first half of the lunch hour is not less than the predetermined magnitude $K_3$, the step 324 sets a starting time $LSJ_o$. Thereafter, when the elevator cars decreased in load as described above appear continuously within the predetermined time interval $K_4$, the operation in the first half of the lunch hour is regarded as being continuous. However, in the absence of such elevator cars within the predetermined time interval $K_4$ as determined in the step 318, the step 320 set an ending time $LEJ_o$ to the end of the predetermined time interval $K_4$.

A decrease in load $LDO_n$ on the elevator car can be determined by subtracting from a load on the elevator car just reaching the restaurant floor, a load upon the initiation of opening of the associated elevator car as described, for example, in Japanese laid-open patent application No. 70,544/1979.

Subsequently, calculation is effected in terms of the mean values of the starting and ending times during the past M days and dispersions of those times, in accordance with a program (not shown) similar to that shown in FIG. 4. Then, the operation of the elevator cars is set or released in the first half of the lunch hour in accordance with a program (not shown) similar to that shown in FIG. 5. In that operation, the elevator cars directed toward the restaurant floor are arranged to quickly reach the restaurant floor by passing a greater part of the elevator cars under full loading through an intermediate floor or floors. This measure is not directly pertinent to the present invention but it is described, for example, in Japanese laid open patent application No. 88,075/1981.

From the foregoing it is seen that the present invention comprises means for sensing and recording a time when a traffic pattern is selected on every day and a means for predicting a time when the present or future traffic pattern is selected from the sensed times of selection of the past traffic patterns. Thus, the present invention can flexibly accommodate any variation in traffic and predict a traffic pattern with a high accuracy.

Also, the present invention is responsive to a dispersion of times of selection of sensed past traffic patterns in excess of a predetermined magnitude to set a predetermined time of selection of a traffic pattern. Thus, in an unstable traffic situation and/or with the statistical device not put in normal operation, abnormal service can be prevented from occurring.

While the present invention has been illustrated in conjunction with a few preferred embodiments thereof, it is to be understood that numerous changes and modifications may be resorted to without departing from the scope and spirit of the present invention.

What is claimed is:

1. An elevator supervision system for supervising the operation of elevator cars by determining statistics of past traffic statuses of said elevator cars with respect to a time thereof on every day by a statistical device, and for predicting a present or a future traffic status of said elevator cars from the results of said statistics, which system comprises a traffic pattern sensing means for sensing the occurrence of a load on said elevator car which is not less than a predetermined magnitude and for also sensing the absence of said elevator cars with said loads which are not less than said predetermined magnitude, said traffic pattern sensing means recording a time of the occurrence of said load and a time of the absence of said elevator cars with said loads, and a traffic pattern selecting means for predicting a time of selection of a present or a future traffic pattern of said elevator cars on the basis of said recorded times.

2. An elevator supervision system as claimed in claim 1, wherein said traffic pattern sensing means is responsive to the occurrence of said load on said elevator car so as to deliver to said statistical device a time signal used with the determination of a starting time of selection of traffic pattern of said elevator cars and is also responsive to the absence of said elevator cars with said loads so as to deliver to said statistical device a time signal used with the determination of ending time of selection of said traffic pattern of said elevator cars.

3. An elevator supervision system for supervising the operation of elevator cars by determining statistics of past traffic statuses of said elevator cars with respect to a time thereof on every day, and for predicting a present or a future traffic status of said elevator cars from the results of said statistics, which system comprises a traffic pattern sensing means for sensing and recording a time of selection of a traffic pattern of said elevator cars on every day, and a traffic pattern selecting means for predicting a time of selection of a present or a future traffic pattern of said elevator car from said sensed times of selection of said past traffic patterns; wherein said traffic pattern sensing means is responsive to a load on said elevator car which is not less than a predetermined magnitude so as to determine a starting time of selection of siad traffic pattern of said elevator cars and is also responsive to the absence of said elevator cars with said loads which are not less than said predetermined magnitude for a predetermined time interval so as to determine an ending time of selection of said traffic pattern of said elevator cars.

4. An elevator supervision system for supervising the operation of elevator cars by determining statistics of past traffic statuses of said elevator cars with respect to a time thereof on every day, and for predicting a present or a future traffic status of said elevator cars from the results of said statistics, which system comprises a traffic pattern sensing means for sensing and recording a time of selection of a traffic pattern selecting means for predicting a time of selection of a present or a future traffic pattern of said elevator car from said sensed times of selection of said past traffic patterns; wherein said traffic pattern selecting means calculates the mean value of said sensed times of said past traffic patterns and predicts a time of selection of a present or a future traffic pattern from said calculated mean value.

5. An elevator supervision system for supervising the operation of elevator cars by determining statistics of past traffic statuses of said elevator cars with respect to a time thereof on every day, and for predicting a present or a future traffic status of said elevator cars from the results of said statistics, which system comprises a traffic pattern sensing means for sensing and recording a time of selection of a traffic pattern of said elevator cars on every day, and a traffic pattern selecting means for predicting a time of selection of a present or future traffic pattern of said elevator car from said sensed times of selection of said said past traffic patterns, and a traffic pattern setting means for calculating a dispersion of said sensed times of selection of said past traffic pattern and for setting a predetermined time or selection of said traffic pattern in response to said calculated dispersion which is not less than a predetermined magnitude.

* * * * *